United States Patent [19]

Giallombardo

[11] 4,326,711

[45] Apr. 27, 1982

[54] QUESTION AND ANSWER GAME EMPLOYING CHANCE-TAKING MEANS

[76] Inventor: Gary P. Giallombardo, 1378 Golden Gate Blvd., Mayfield Hts., Ohio 44124

[21] Appl. No.: 159,376

[22] Filed: Jun. 13, 1980

[51] Int. Cl.[3] ..... A63F 5/04; A63F 9/18

[52] U.S. Cl. ..... 273/1 R; 434/327; 273/142 HA

[58] Field of Search ..... 273/141 R, 1 R, 142; 434/322, 327, 347

[56] References Cited

U.S. PATENT DOCUMENTS

| | | | |
|---|---|---|---|
| 2,676,019 | 4/1954 | Steinberg | 273/141 R |
| 2,917,325 | 12/1959 | Sines | 283/63 R |
| 3,559,995 | 2/1971 | Steadman | 273/141 R |
| 3,720,369 | 3/1973 | Alvarado | 235/78 |
| 3,850,433 | 11/1974 | Purlia | 273/142 E |
| 3,918,174 | 11/1975 | Miller et al. | 283/6 X |

*Primary Examiner*—George J. Marlo
*Attorney, Agent, or Firm*—Burge & Porter Co.

[57] ABSTRACT

A question and answer game includes a book of questions and answers divided into separate categories, as well as a chance-taking device for determining in random matter questions to be asked of participants. The categories of questions are related to a common theme, such as television shows, and each category deals with a separate item within the common theme, such as game shows, situation comedies, westerns, and the like. Each item is further broken down to include a number of shows classifiable within that item. The chance-taking device includes a selector having relatively movable portions and a set of guide cards for directing operation of the selector. The game apparatus also includes a plurality of cards displaying different items within a given category such as television personalities, television shows, and the like. Answers to questions posed by the cards are contained within the book. During play of the game, players may gamble on whether they will succeed in answering questions about to be posed to them.

9 Claims, 9 Drawing Figures

QUESTION AND ANSWER GAME EMPLOYING CHANCE-TAKING MEANS

BACKGROUND OF THE INVENTION

1. Field of the Invention

The invention relates to games and, more particularly, to a question and answer game in which access to a book containing questions and answers is controlled by a chance-taking means.

2. Description of the Prior Art

A number of prior games are known in which a chance-taking means in the form of a spinner or the like is employed in conjunction with a book or a game board. In a typical prior game, a two-part spinner is used to direct players to portions of a question and answer book. For example, one spinner might indicate which page of the book is to be consulted, while another spinner might indicate which question on the consulted page is to be asked of participants. A problem with this construction is its limited nature. Unless the spinner apparatus is very complexly configured, it is difficult to include a great number of questions and answers in the book. Accordingly, the game can be easily mastered after it has been played for only a short period of time and no longer presents a challenge to the players.

Prior games employing chance-taking means have dealt with a variety of subjects. The subjects include real estate acquisition, patent transactions, zodiac indications, trivia questions, and a great variety of other subjects. There is a continuing market for games which challenge individuals in new and different ways. A particular challenge relates to questions and answers dealing with television shows. Television, as a medium of entertainment and education, is relatively new and unique. It has become so popular that it is estimated that there is at least one television set for each household. Desirably, a question and answer game would make use of information relating to television.

SUMMARY OF THE INVENTION

In response to the foregoing considerations, the present invention provides a new and improved game apparatus employing a book of questions and answers divided into separate categories, as well as a chance-taking means for determining in random manner questions to be asked of participants. In a preferred embodiment, the categories of questions are related to a common theme, such as television shows, and each category deals with a separate item within the common theme, such as game shows, situation comedies, westerns, and the like. Each item is further broken down to include a number of shows classifiable within that item.

The chance-taking means includes a selector having relatively movable portions and a set of guide cards for directing operation of the selector. In response to directions supplied by the guide cards, the selector is activated to select one of the categories such as situation comedies, westerns, game shows, and so forth. Further operation of the selector results in a particular show classifiable within the selected item to be displayed at random. Upon consulting the question and answer book, and by referring to the guide card initially employed to activate the selector, a particular question can be asked of the participant.

Certain of the categories are identified by a separate set of cards, rather than by questions contained in the book. For example, the categories might be "television personalities," "television shows" and the like. Pictures of television personalities and scenes taken from television shows can serve as the questions to be asked of participants. Answers to the "card" questions are contained in the book. During play of the game, players may gamble on whether they will succeed in answering questions about to be posed to them.

For a more complete understanding of the invention, including a description of the manner of play, reference is made to the specification as well as to the accompanying drawings which form a part of the disclosure of the invention.

DESCRIPTION OF THE PREFERRED EMBODIMENT

Figure 1:
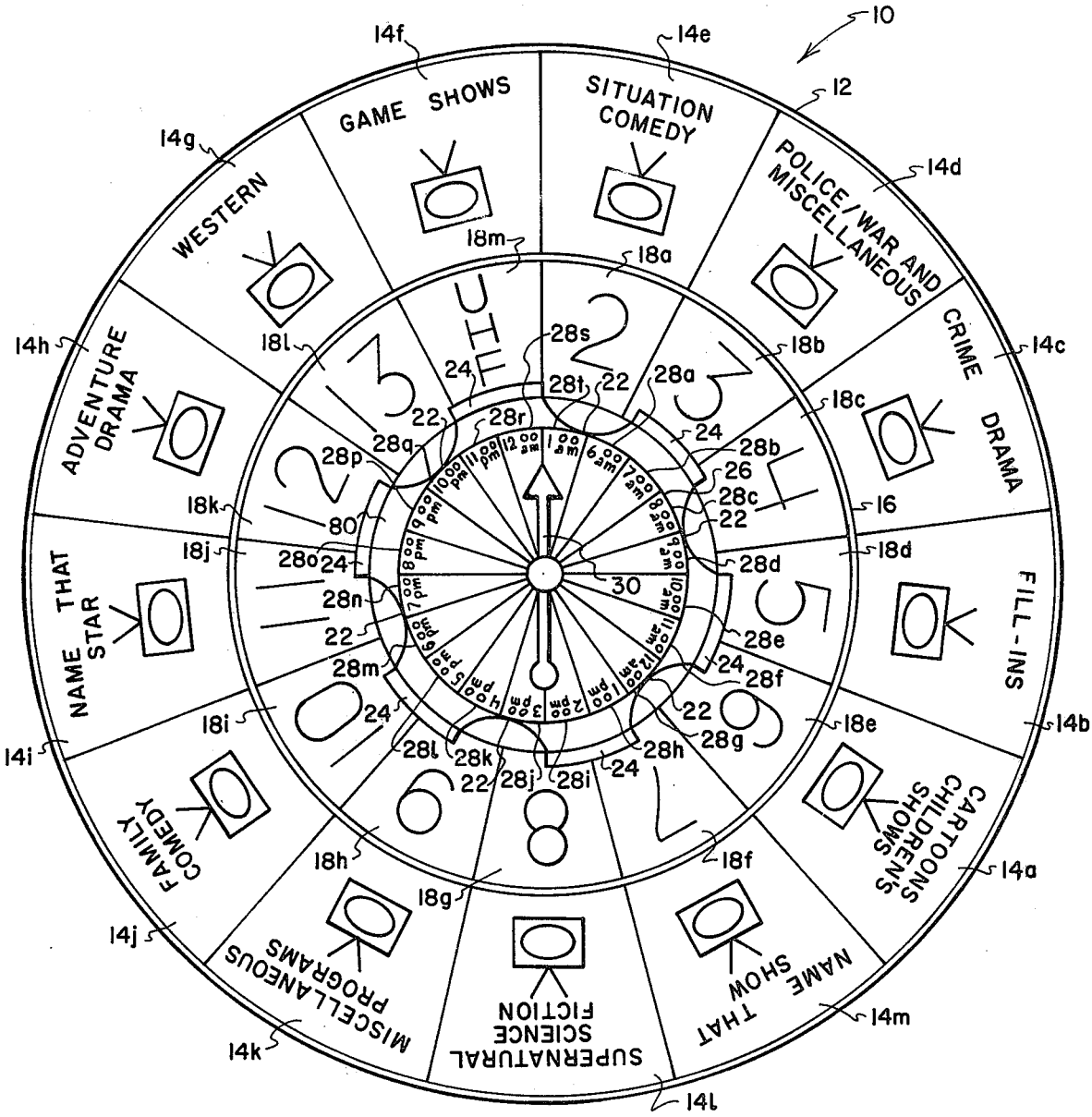
FIG. 1 is a plan view of a selector included as part of a chance-taking means according to the invention, showing representative indicia as the selector might be used in a television trivia game.
Figure 2:
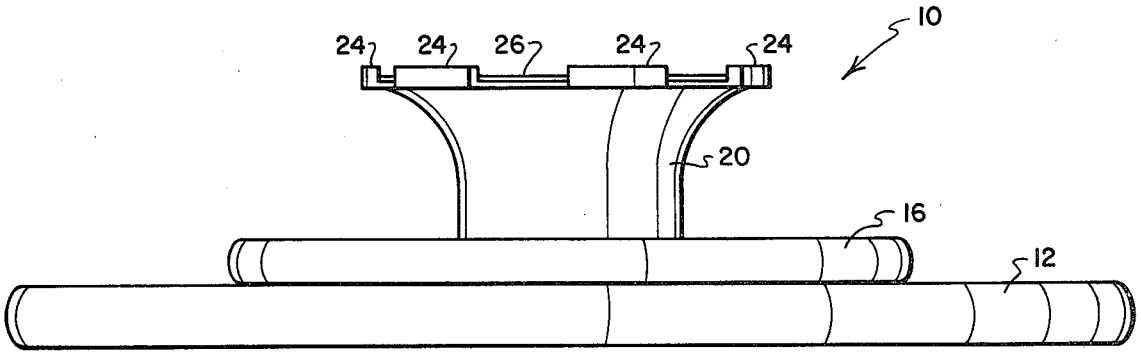
FIG. 2 is a side elevational view of the selector of FIG. 1.
Figure 3:
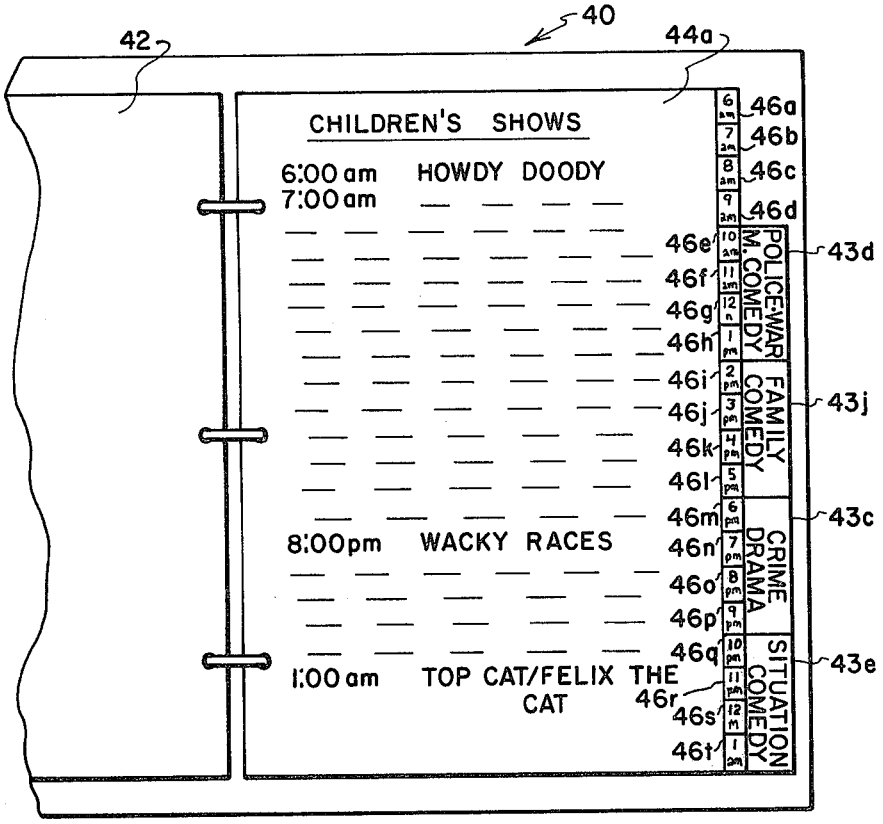
FIG. 3 is a view of a book according to the invention, the book being opened to show an index of items for one category of items.

Referring to the FIGURES, game apparatus according to the invention includes a selector 10 and a question and answer book 40. A plurality of so-called guide cards 50 are employed to control operation of the selector 10 and coordinate play of the game with the question and answer book 40. Together, the selector 10 and the guide cards 50 define a chance-taking means for selecting at random questions to be asked of participants. The apparatus also includes a first set of special item cards 60, as well as a second set of sepcial item cards 70.

The selector 10 includes a large, stationary, disc-like base portion 12 having a plurality of equidistantly spaced sectors 14*a*–14*m* disposed near the periphery. Each sector 14 defines a separate category. The illustrated example is particularly useful as a television trivia game, and the sectors 14 include:

14*a*. Cartoons/Childrens shows
14*b*. Fill-Ins
14*c*. Crime Drama
14*d*. Comedy—Police, War and Miscellaneous
14*e*. Situation Comedy
14*f*. Game Shows
14*g*. Western
14*h*. Adventure Drama
14*i*. Name That Star 14*j*. Family Comedy
14*k*. Miscellaneous Programs
14*l*. Supernatural and Science Fiction
14*m*. Name That Show The selector 10 includes a disc-like central portion 16 relatively movable with respect to the base portion 12. The portion 16, like the portion 12, includes a plurality of sectors 18*a*–18*m* equidistantly spaced near its periphery. The sectors 18 are identified with a separate television channel identification and, in this case, include:

18*a*. Channel 2
18*b*. Channel 3
18*c*. Channel 4
18*d*. Channel 5
18*e*. Channel 6
18*f*. Channel 7
18*g*. Channel 8
18*h*. Channel 9
18*i*. Channel 10
18*j*. Channel 11
18*k*. Channel 12
18*l*. Channel 13
18*m*. UHF The central portion 16 includes a vertically extending column 20 having, at its upper end, a plurality of equidistantly spaced indented portions 22. The column 20 is rigidly secured to the central portion 16 so that, upon spinning the column 20, the central portion 16 will be rotated with respect to the base portion 12. The indented portions 22 make it easier for one to grasp the column and spin it.

The column 20 also includes a plurality of vertically extending flanges 24. The flanges 24 define the outermost portion of the indented portions 22. A disc 26 is fitted within a circular boundry defined by the innermost portion of the indented portions 22. The disc 26 includes sectors 28*a*–28*m* located equidistantly circumferentially of the disc 26. Each sector 28*a*–28*m* includes indicia indentifying a different time of the day, such as 6:00 a.m., 2:00 p.m., and so forth. A spinner 30 is mounted for rotation centrally of the disc 26. Upon activating the spinner 30, indicia presented by the sectors 28 can be selected at random. Taken together, the disc 26 and the spinner 30 constitute a selection means for selecting in random fashion a time slot for a particular television show.

Referring to FIGS. 3–6, the book 40 includes a plurality of divider pages 42 having tabs 43*a*–43*m* corresponding to indicia included as part of the sectors 14*a*–14*m*. A divider page 42 having a tab 42*n* (not shown) sets apart a section of the book 40 for a "UHF-commercial" section, as will be discussed. Upon grasping the tab 43*a*, (not shown) an index sheet 44*a* is presented. The index sheet 44*a* lists a plurality of items within the category of "Cartoons/Childrens Shows" and lists these items separately. Each item is listed according to a pre-selected time slot. In the example given, the television show "Howdy Doody" is listed as being shown at 6:00 a.m., while the show "Wacky Races" is listed as being shown at 8:00 p.m., and so forth. A plurality of small tabs 46*a*–46*t* project along the side of the index page 44*a*. Each of the small tabs 46 is identified with a time such as 6:00 a.m., 3:00 p.m., and so forth. The time periods indicated on the small tabs 46*a*–46*m* correspond with the time periods listed on the index sheet 44*a* and on the sectors 28*a*–28*t*.

Figure 4:
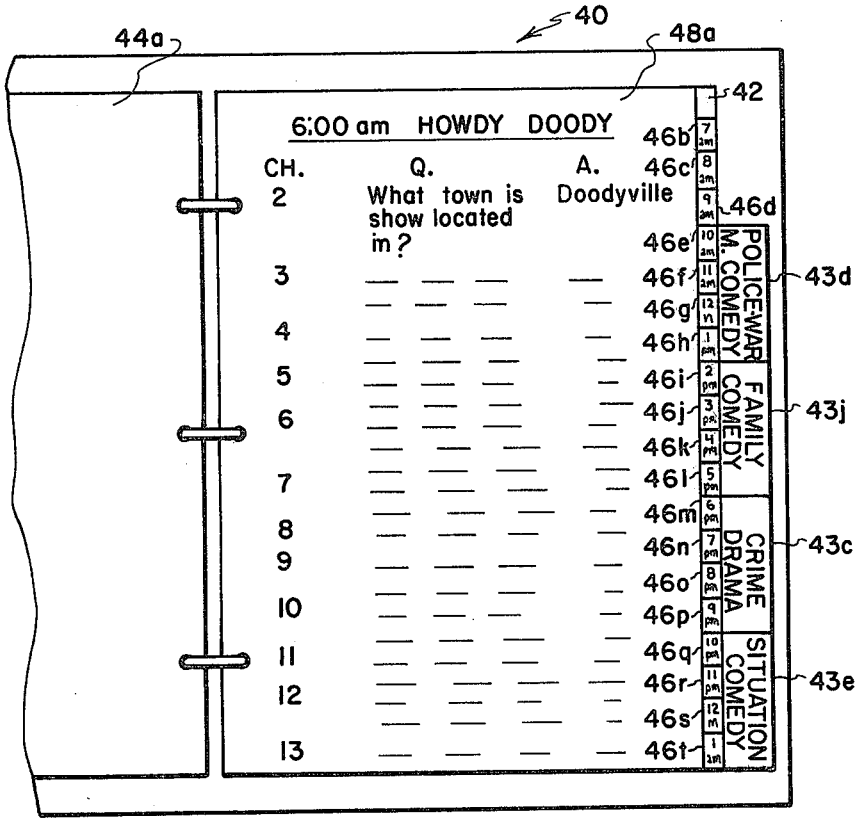
FIG. 4 is a view similar to FIG. 3, but showing the book turned to a question and answer page for one of the items illustrated in FIG. 3.

Referring to FIG. 4, it will be assumed that the tab 46*a* corresponding to 6:00 a.m. has been grasped and the page opened. A so-called item page 48*a* is displayed. The heading of the item page 48*a* corresponds with the listing on the index sheet 44*a* for the corresponding time period. Twelve questions are presented on the sheet 48*a*, the questions being identified by the indications "Channel 2" through "Channel 13." Each channel indication is listed beside a question. Each question is listed with its proper answer.

Figure 5:
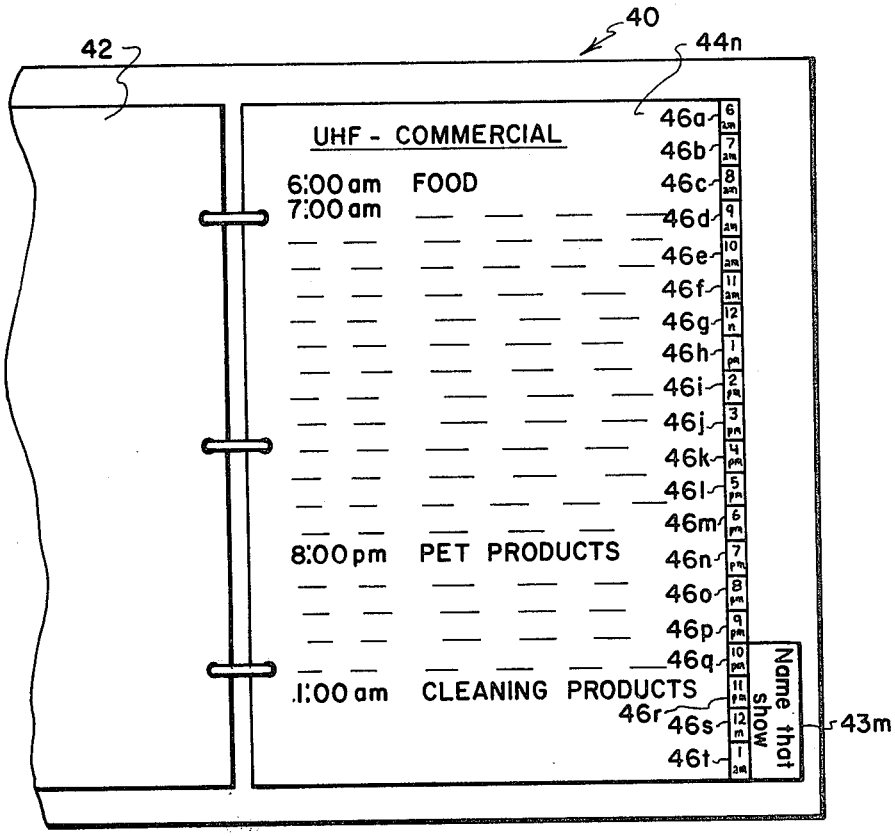
FIG. 5 is a view similar to FIG. 3, showing the index to another category of items.
Figure 6:
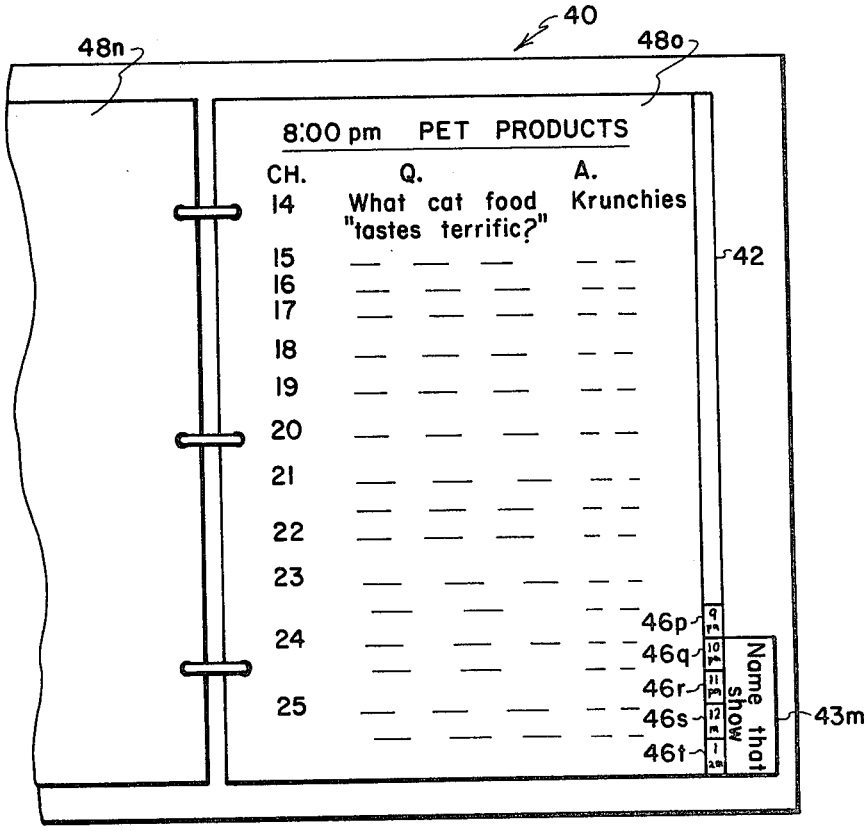
FIG. 6 is a view similar to FIG. 5, showing the book turned to a question and answer page for one of the items illustrated in FIG. 5.

Referring to FIGS. 5 and 6, an index sheet 44*n* is shown for the category "UHF-Commercial." In a manner similar to the other index sheets 44*a*–44*m*, the UHF index sheet 44*n* includes a listing of items accompanied by corresponding time periods. A plurality of small tabs 46*a*–46*t* project outwardly of the index sheet 44*n*. Indicia on the tabs 46*a*–46*t* correspond with the time periods indicated on the index sheet 44*n*. The tabs 46*a*–46*t* are attached to item pages 48*a*–48*t*. FIG. 6 shows a representative time period (8:00 p.m.) displayed on the item page 48*o*. Twelve questions are presented, accompanied by the proper answers. Each question and answer is identified by a channel number indication corresponding with channel number indications "Channel 14" through "Channel 25."

Figure 9:
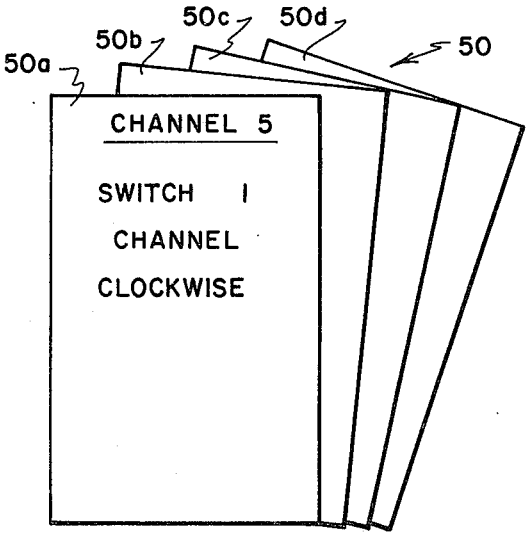
FIG. 9 is a view of a set of cards for directing operation of the selector illustrated in FIGS. 1 and 2, a representative card being shown.

Referring to FIG. 9, the chance-taking means 10 further includes a plurality of so-called guide cards 50. Each guide card 50 includes a category identification number and can be identified separately as 50*a*, 50*b*, and so forth. In the case of a television game show, the category identification numbers are selected as television channels; That is, channels 2, 3, 4, 5, 6, 7, 8, 9, 10, 11, 12 and UHF. Five channel identification cards are provided for each channel. Each card includes directions for indicating the selection of a particular category of television show. Typical guide gards 50 are as follows:

Channel 2—Switch 4 channels counter-clockwise
Channel 2—Switch 1 channel clockwise
Channel 2—Switch 2 channels counter-clockwise
Channel 2—Don't touch that dial Channel 3—Switch 1 channel clockwise
Channel 3—Switch 3 channels clockwise
Channel 3—Switch 2 channels counter-clockwise
Channel 3—Switch 4 channels counter-clockwise
Channel 3–Switch 4 channels clockwise Channel 4—Switch 4 channels clockwise
Channel 4—Switch 1 channel counter-clockwise
Channel 4—Switch 4 channels counter-clockwise
Channel 4—Switch 1 channel clockwise
Channel 4—Don't touch that dial UHF—Commercial—Channel 14
UHF—Commercial—Channel 15
UHF—Commercial—Channel 16
UHF—Commercial—Channel 17
UHF—Commercial—Channel 18
UHF—Commercial—Channel 19
UHF—Commercial—Channel 20
UHF—Commercial—Channel 21
UHF—Commercial—Channel 22
UHF—Commercial—Channel 23
UHF—Commercial—Channel 24
UHF—Commercial—Channel 25

A total of 72 guide cards are provided. The channel indications included as part of the "UHF" cards indicate questions to be asked when a UHF channel has been selected.

Figure 7:
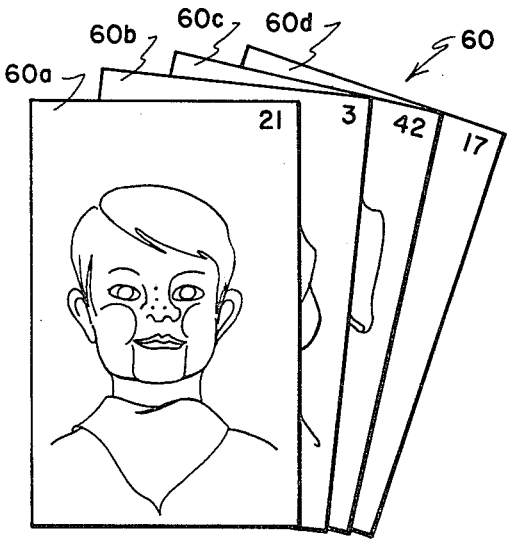
FIG. 7 is a view of a first set of cards according to the invention, a representative card being illustrated.
Figure 8:
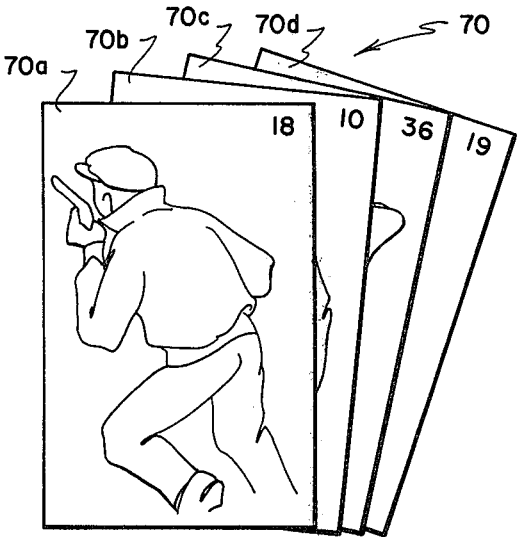
FIG. 8 is a view of a second set of cards according to the invention, a representative card being shown.

Referring to FIGS. 7 and 8, special item cards 60, 70 are shown. Special item cards 60 are referred to as "Star" cards. Each of the special item cards 60 is identified with a separate number in its upper right-hand corner and includes the likeness of a well-known television personality. Each of the special item cards 60 shown in FIG. 7 can be identified separately as 60*a*, 60*b*, and so forth. Similarly, special item cards 70 are referred to as "Show" cards and are identified with separate numbers in their upper righthand corners. The special item cards 70 include scenes from television shows. Each of the special item cards 70 shown in FIG. 8 can be identified separately as 70*a*, 70*b*, and so forth. The book 40 includes divider pages 42 having tabs 43*i* and 43*m* to separate answer sheets for the categories "Name that Star" and "Name that Show," respectively. The answer sheets for the Name that Show and Name that Star categories include answers for all the cards 60, 70. The answers are listed numerically corresponding to the numbers in the upper right-hand corner of each of the sets of cards 60, 70.

The invention also includes play money (not shown) in various denominations such as $10, $20, $50, and $100. The denominations used with the invention can be chosen as desired.

OPERATION

In order to play the game, the selector 10 is placed on the floor or on a table and players congregate around the selector 10. The guide cards 50 and the special item cards 60, 70 are shuffled and placed face down in three separate decks. Two or more players are required to play the game, and presumably each of the players will be at least 12 years of age.

The basic object of the game is to acquire as much play money as possible. Play money is acquired by answering questions correctly. By way of example, the answer to each question can be worth $10. If both the first and last name in a question calling for a two-part name answer are given, the answer can be worth $20. Before a question is asked, a player is permitted to gamble up to $100. If the player incorrectly answers the question, he loses the gambled sum. If the player correctly answers the question, he receives the gambled sum plus $10 (or $20 as the case may be) for the correct answer. If a player cannot answer the question posed to him, the question is asked of the player next in turn. If all of the players fail to answer the question correctly, then the answer is read and the play of the game is continued.

The game is commenced by a selected player choosing a guide card 50 on top of the deck containing the guide cards 50. It will be assumed that the guide card 50*a* shown in FIG. 9 has been selected. The player who has drawn the guide card 50*a* will grasp the column 20 and spin it to reposition the sectors 14, 18 with respect to each other. It will be assumed that the sector alignment shown in FIG. 1 has resulted. Accordingly, upon switching channel 5 one channel clockwise as called for by the guide card 50*a*, the category "Cartoons/Childrens Shows" will be indicated. The question and answer book 40 then is opened to the index sheet 44*a* displaying the heading "Cartoons/Childrens Shows" by grasping the tab 43*a*. Next, the player spins the spinner 30. It will be assumed that a time of 6:00 a.m. has been selected. The show indicated at 6:00 a.m. is "Howdy Doody." At this point, the player is permitted to gamble on whether he will be able to answer the question about to be posed to him.

After a gamble has been declined or placed, the small tab 46*a* indicating 6:00 a.m. is grasped and the page is opened. Referring to FIG. 4, the channels and questions and answers for the Howdy Doody television show will be presented. Because the player initially drew a guide card labeled "Channel 5" the question positioned opposite Channel 5 is asked. The player has 60 seconds in which to correctly answer the question. If the question cannot be answered or is answered incorrectly, the question is asked of the next player and so forth as indicated previously. The game is over after the players go through all of the guide cards 50.

If one of the "UHF" guide cards 50 has been drawn, play would have proceeded exactly as outlined above. The only difference would be that individual questions and answers are identified with the notations Channel 14–25 rather than Channels 2–13.

If the player initially had chosen the category of "Name That Show" or "Name That Star" play would have proceeded similarly, except that the special item cards 60, 70 would have been referred to, as appropriate. For example, if the category "Name That Star" has been selected, the player would be given a chance to gamble and, thereafter, one of the special item cards 60 would be drawn. If the player can successfully identify the television personality depicted on the card, reference being had to the answer pages in the book 40 identified by the tabs 43*i*, 43*m*, the player will win whatever has been gambled plus $10 (or $20 if a two-part name has been answered).

It will be appreciated that the game apparatus according to the invention provides a considerable challenge to the participants. In the particular example illustrated, 14 separate categories are provided, consisting of sectors 14*a*–14*m* and "UHF." Twelve of the 14 categories include 20 separate items (corresponding with time slots from 6:00 a.m. to 1:00 a.m.). Furthermore, each of the items includes twelve questions (corresponding with channels 2–13 or 14–25). Additionally, although any number of special item cards 60, 70 could be provided, it will be expected that at least 50 stars and 50 shows will be depicted. Thus, a total of almost 3000 separate questions and answers are included as part of the question and answer book 40.

Although the invention has been described with a certain degree of particularity, it will be understood that the present disclosure of the invention has been made only by way of example, and that various changes and modifications can be made without departing from the true spirit and scope of the invention as hereinafter claimed. It is intended that the patent shall cover, by suitable expression in the appended claims, whatever features of patentable novelty exist in the invention disclosed.

What is claimed is:

1. In a question and answer game, game apparatus comprising, in combination:

(a) chance-taking means for determining in random manner questions to be asked of participants; and (b) a question and answer book containing questions to be asked of participants as directed by the chance-taking means, the question and answer book also including answers to each of the questions, the question and answer book including a plurality of index sheets for displaying categories of items, each index sheet being identified by a tab projecting outwardly of the sheets, each index sheet including a listing of particular items within a given category, the items being listed by uniquely identifiable indicia, and a plurality of item pages, each item page being identified by a tab projecting outwardly of the sheets, each item page including a plurality of questions and answers involving that item, each question and answer being uniquely identified by identifying indicia.

2. The game apparatus of claim 1, wherein the subject matter of the apparatus is television shows, and wherein the categories include types of television shows, the items include individual television shows within a given category of television show, and the individual questions and answers involve details of the individual television shows.

3. The game apparatus of claim 2, further comprising a plurality of special item cards, each special item card displaying indicia constituting a question to be asked of participants, and wherein the question and answer book includes an item page having answers to the questions posed by the special item cards.

4. The game apparatus of claim 3, wherein two sets of special item cards are provided, one set of special item cards dealing with the subject matter of television personalities, and the other set of special item cards dealing with the subject matter of television shows.

5. The game apparatus of claim 1, wherein the chance-taking means includes a selector, the selector including a base portion having indicia spaced about its periphery, the indicia identifying separate categories, the separate category identification being keyed to the tabs extending outwardly of the index sheets, a central portion relatively movable with respect to the base portion, the central portion including indicia spaced about its periphery, the indicia setting forth designations capable of uniquely identifying questions and answers within a selected item, the question and answer designations corresponding with question and answer designations included as part of the item pages, and a card positioned atop the central portion, the card including indicia setting forth item designations and a spinner for selecting item designations at random, the item designations corresponding with item designations included as part of the index sheets.

6. The game apparatus of claim 5, further comprising a plurality of guide cards for controlling operation of the selector, each guide card including directions for moving the central portion relative to the base portion.

7. The game apparatus of claim 1, further comprising a plurality of special item cards, each special item card displaying indicia constituting a question to be asked of participants, and wherein the question and answer book includes an item page having answers to the questions posed by the special item cards.

8. Game apparatus for interrogating participants regarding facts concerning television shows, comprising:

(a) a selector for at least partially determining questions to be asked of participants, the selector including:

(i) a base portion having indicia identifying a plurality of categories of television shows, the indicia being spaced about the periphery of the base portion;

(ii) a central portion relatively movable with respect to the base portion, the central portion including a plurality of indicia, each indicia identifying a separate television channel which may be aligned with individual ones of the television category indicia displayed by the base portion, the television channel indicia being spaced about the periphery of the central portion; and, (iii) a card positioned centrally of the central portion, the card including indicia identifying individual time slots during which television shows may be presented, the card including a spinner located centrally of the card such that, upon activation of the spinner, individual time slots can be chosen at random;

(b) a plurality of guide cards, each guide card including indicia for controlling at least partially the relative positions of the base portion and the central portion;

(c) a plurality of special item cards, each special item card displaying indicia constituting a question to be asked of participants, the indicia including television personalities and scenes from television shows; and (d) a question and answer book, the book including:

(i) a plurality of index sheets, each index sheet dealing with a separate category of television show, each index sheet being identified by a tab extending outwardly of the sheets, each index sheet including a list of items, the items consisting of individual television shows within the particular category;

(ii) a plurality of item pages, each item page being identified by a tab extending outwardly of the sheets, the item pages displaying questions and answers related to the individual television shows within the categories set forth by the associated index sheets; and (iii) the questions and associated answers on each item page being identified by one of the television channel indicia displayed by the central portion.

9. The game apparatus of claim 8, wherein at least 14 categories, 12 channel indications, and 20 time slots are provided.

* * * * *